United States Patent [19]

Dinius

[11] Patent Number: 4,671,430

[45] Date of Patent: Jun. 9, 1987

[54] POWDERED MATERIAL APPORTIONING APPARATUS

[75] Inventor: Harold B. Dinius, Mooresville, Ind.

[73] Assignee: Eli Lilly and Company, Indianapolis, Ind.

[21] Appl. No.: 735,772

[22] Filed: May 20, 1985

[51] Int. Cl.[4] ..... G01F 11/28

[52] U.S. Cl. ..... 222/135; 222/144; 222/152; 222/284; 222/306; 222/368; 222/636; 384/152

[58] Field of Search ..... 222/144, 152, 283, 284, 222/305, 306, 367, 368, 636, 135; 384/152, 275, 276, 439

[56] References Cited

U.S. PATENT DOCUMENTS

| | | | |
|---|---|---|---|
| 1,478,829 | 12/1923 | Liberman et al. | 222/306 X |
| 1,513,373 | 10/1924 | Corporon | 222/306 X |
| 1,563,756 | 12/1925 | Liberman | 222/306 X |
| 1,621,307 | 3/1927 | Benzel | 222/306 X |
| 2,540,059 | 1/1951 | Stirn et al. . | |
| 2,684,186 | 7/1954 | Mottos | 222/306 X |
| 2,690,360 | 9/1954 | Young | 384/152 |
| 3,090,524 | 5/1963 | Corcoran | 222/306 X |
| 3,312,151 | 4/1967 | Molins . | |
| 3,578,217 | 5/1971 | Miller | 222/306 X |
| 3,656,518 | 4/1972 | Aronson . | |
| 3,776,611 | 12/1973 | Jentsch | 384/152 |
| 3,829,106 | 8/1974 | Wheelock | 384/152 |
| 4,005,668 | 2/1977 | Washington et al. . | |
| 4,039,232 | 8/1977 | Vinciguerra | 384/152 |
| 4,350,049 | 9/1982 | Gupte et al. . | |
| 4,371,101 | 2/1983 | Cane et al. . | |
| 4,462,740 | 7/1984 | Cytra | 222/308 X |

*Primary Examiner*—L. J. Paperner
*Assistant Examiner*—P. McCoy Smith
*Attorney, Agent, or Firm*—Barnes & Thornburg

[57] ABSTRACT

An apparatus for apportioning powdered material into each of a series of containers is disclosed which includes a powdered material hopper having a dispensing opening and a rotatable filling head contiguous to the dispensing opening. The rotatable filling head includes a plurality of radially situated chambers each having an open outer end for displacement between the material hopper and the series of containers. A conventional pneumatic source is provided for assisting the filling and emptying of the chambers during the apportioning process. Within each chamber, the volume of powdered material received is defined by a piston having a porous surface. The piston engages a threaded stem longitudinally fixed in position yet rotatable about its longitudinal axis to effect displacement of the piston head and support longitudinally within the chamber. A seal is provided at the radially inner end of the threaded stem to ensure positive pneumatic action through the porous piston surface.

4 Claims, 4 Drawing Figures

POWDERED MATERIAL APPORTIONING APPARATUS

The present invention relates generally to an apparatus for filling containers with powdered material. The present invention particularly relates to such apparatus which includes a chamber of preselected cross-section having a movable porous wall, the chamber being filled from a source of the powdered material with the aid of a vacuum applied to the chamber through the wall. Such apparatus generally also employs a pressurized gas to aid in the ejection of the powdered material from the chamber.

The present invention is directed particularly to apparatus for positioning the porous wall within the chamber in such a manner that the porous wall will remain fixed in the selected position during use but can be easily moved when necessary to either enlarge or diminish the length of the chamber and thereby modify the volume of material which can be held by the chamber. While the present invention may be used for filling containers with various powders such as talcum, sugar, explosives, and the like, it has particular utility in the filling of powdered pharmaceutical materials into containers suitable for parenteral use subsequent to solution or suspension with an appropriate liquid.

The present invention relates even more specifically to an improvement in apparatus disclosed in U.S. Pat. No. 2,540,059. That patent discloses a device for measuring and filling powders volumetrically which includes a filling head in the form of a wheel or turret mounted for rotation below a hopper containing the material to be filled. The wheel or turret includes a plurality of radial chambers containing a foraminous member which can be moved within the chamber by means of a threaded adjusting member which may be screwed in and out of a sleeve assembly within each chamber. As the adjusting member is moved so as to enlarge the volume of the chamber, the adjusting member projects inwardly toward the axis of rotation of the wheel or turret. The inwardly projecting portions of the plurality of adjusting members can interfere with each other as the volume of the chambers are enlarged. The adjustable member is thus limited to a predetermined length of travel which does not permit sufficient variation in chamber volume to achieve all of the variation required in commercial filling operations. In commercial embodiments of apparatus similar to that disclosed in U.S. Pat. No. 2,540,059, adjustable members having different unit lengths are employed so as to achieve all of the variability required for the apparatus as a whole.

In the present invention, a porous piston is situated within a chamber with the aid of a piston support which includes a first threaded surface. A threaded stem engages the first threaded surface of the piston support, the stem being rotatably supported at a fixed longitudinal position within the chamber. The position of the porous piston is changed by means of rotating the threaded stem which in turn causes the piston support to move longitudinally within the chamber while the stem itself remains at a fixed longitudinal position. This feature has the advantage of eliminating any interference between the innermost ends of the threaded stems at the axis of the wheel or turret in which they are mounted. It has the further advantage that the porous piston may be moved over the whole range of permissible positions within the chamber using only a single stem. The present invention includes as another feature the presence of a radially extending flange at an end of the stem to be engaged by a stem support means. This feature enables the stem and stem support to be sealed with the aid of conventional O-rings which do not contact the threaded portion of the stem. This has the advantage of achieving an essentially zero leakage apparatus allowing the pressure and vacuum to be applied through the porous wall in a more controlled manner. Other advantages of the present invention are a reduced need for parts inventory, a simpler preparation of the assembly, more "up-time" of the filling line, faster and easier dose adjustment, and minimization of "dose in-time."

Additional features and advantages of the invention will become apparent to those skilled in the art upon consideration of the following detailed description of a preferred embodiment exemplifying the best mode of carrying out the invention as presently perceived. The detailed description particularly refers to the accompanying figures.

Figure 1:
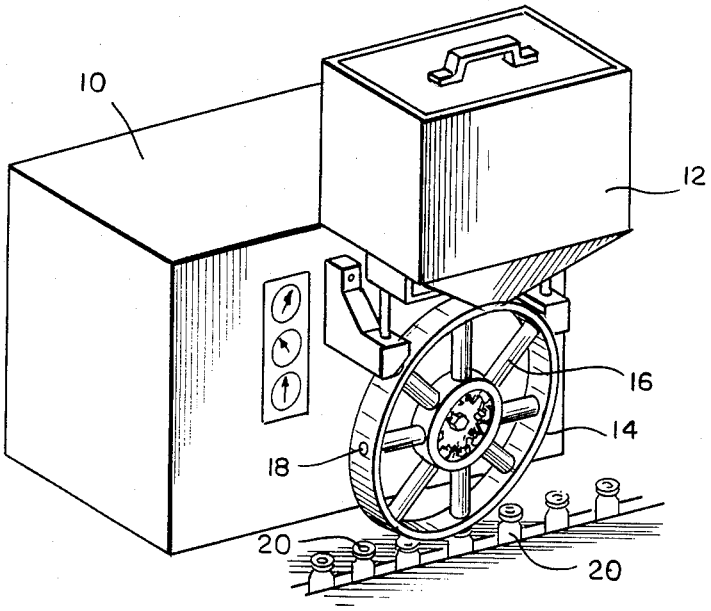
FIG. 1 is a perspective view of an apportioning apparatus in accordance with the present invention.

An apportioning apparatus 10 is shown generally in FIG. 1. The apparatus 10 includes a hopper 12 into which is placed the material desired to be apportioned. The hopper 12 includes a dispensing opening of conventional design at its lower end which cooperates with a rotatable filling head 14 positioned contiguous to the dispensing opening. The rotatable filling head 14 includes a plurality of radially arranged members 16 each having an open outer end 18 leading to a chamber 19 on the interior of member 16. The apparatus 10 includes a drive means not shown for rotating the filling head 14. The drive means typically includes means to coordinate the rotation of the filling head 14 with the passage of a series of containers 20 below the filling head such that the mouth of each container is situated vertically below an opening 18 as each radial member or spoke 16 moves to the lowest position during rotation of the filling head.

The apparatus 10 also includes pneumatic means in the form of a source of vacuum and a source of pressurized gas which can be introduced into each of the chambers at an appropriate position during the rotation of the head to assist in the filling and emptying of the chambers. The driving means and the pneumatic means employed in the present invention are conventional and disclosed fully in the prior art.

Figure 2:
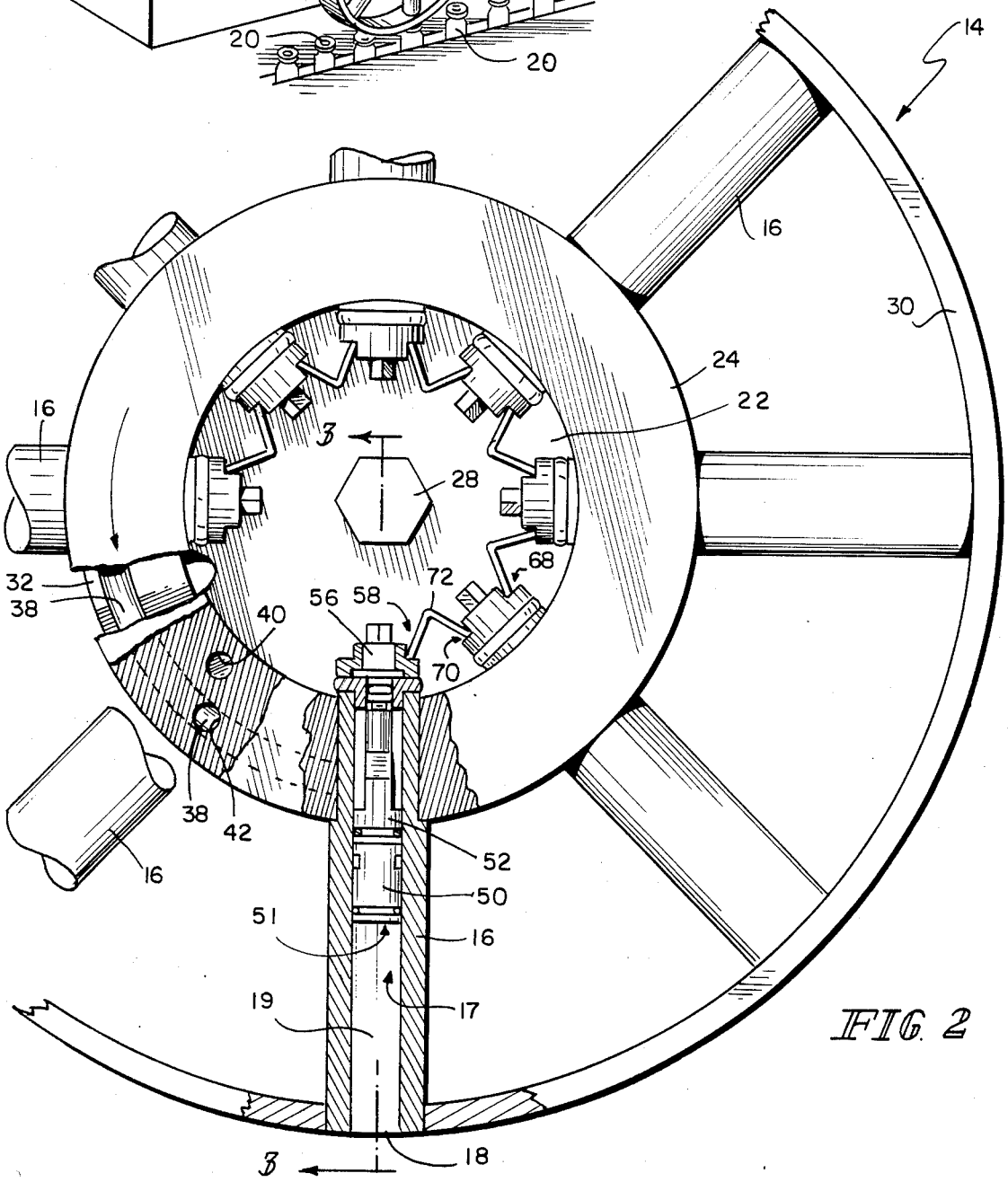
FIG. 2 is a plan view of the dosing wheel shown in FIG. 1 partially broken away.
Figure 3:
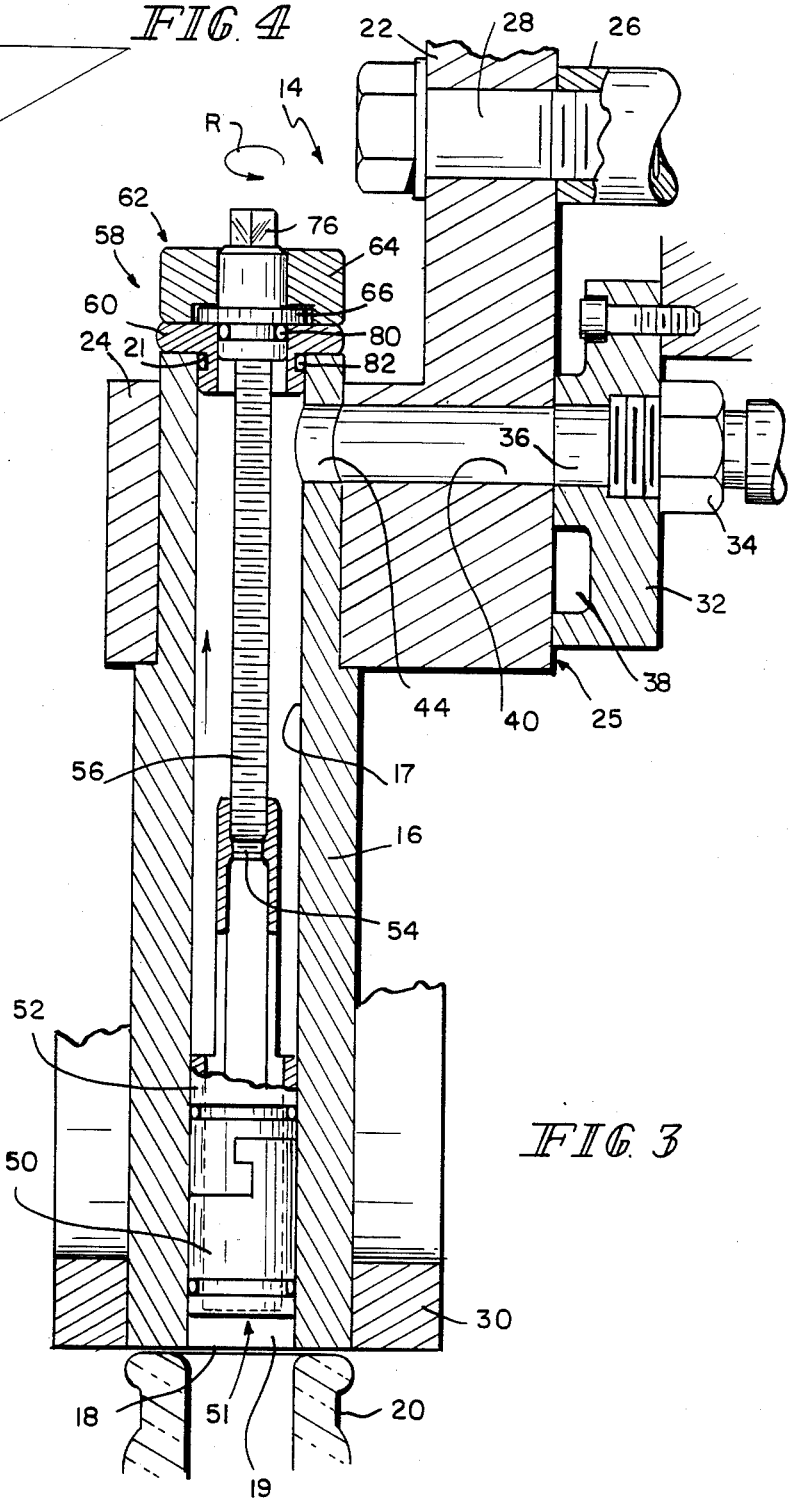
FIG. 3 is a sectional view of the dosing wheel shown in FIG. 2 taken along line 3—3.

As can be seen in greater detail in FIGS. 2 and 3, the filling head 14 comprises a hub 22 including an upstanding flange 24. The hub 22 is fixed to an axle 26 by an appropriate fastening means 28 shown to be a screw-threaded bolt. The hub 22 is surrounded by a rim 30 defining the outer periphery of the filling head. The rim 30 is fixed in position with respect to the hub 22 and flange 24 by the spoke-like radial elements 16. The radial elements 16 are shown to have a cylindrical inner wall 17 defining the chamber 19 having an open outer end 18. The radial member 16 can be secured to the flange 24 and rim 30 by any convenient means such as soldering or welding.

On a back surface 25 of hub 22 is a manifold 32 which in turn is connected to the conventional pneumatic source by connectors 34. The manifold 32 includes channels 36 and 38 connected to the pressure and vacuum sources of the pneumatic means. The channels 36 and 38 are aligned with openings 40 and 42 passing through the flange 24 from the back surface 25 to communicate with chamber 19 through apertures 44. The manifold 32, channels 36 and 38, 40, and 42 are all conventional.

To define the volume of powdered material received in the chamber, a piston 50 having a porous head 51 is situated within the chamber 19. The piston 50 is supported longitudinally at a preselected position by a piston support 52 including a threaded surface 54. A threaded stem 56 engages the threaded surface 54 of the piston support 52 and effects a longitudinal displacement of the piston 50 by means of rotation as shown by arrow R. The stem 56 is longitudinally fixed in position and rotatable about its longitudinal axis by a stem support means 58. The stem support means 58 is shown to comprise a bushing means 60 engaging the radially inner end 21 of chamber 19 and a retaining means 62 for retaining the bushing and stem within the chamber.

Figure 4:
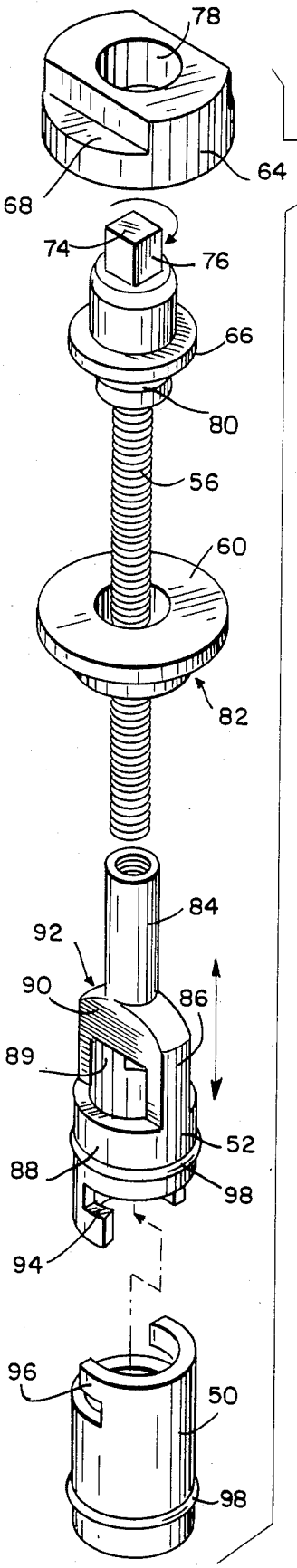
FIG. 4 is an exploded perspective view of the apparatus contained within the chambers shown in FIGS. 2 and 3.

The retaining means 62 in turn is shown to include a cap 64 abutting the bushing 60 and capturing a flange 66 on the head of the stem 56. The cap 64 is shown in FIGS. 2 and 4 to include an opposed pair of flats 68 and 70. The retaining means 62 also includes a clip 72 which is situated between each pair of adjacent caps 64 such that it engages one of the flats 68, 70 on each of the adjacent pairs of caps 64. The clip 72 biases the caps 64 into engagement with the bushing means 60.

The upper end 74 of stem 56 includes a head or other means 76 for engaging a tool to cause rotation of the stem of 56 to effect displacement of the piston head 50 and support 52. The head 76 projects through an aperture 78 in cap 64 so as to readily be accessible for manipulation to adjust the position of piston 50 and, hence, the operative length of cylinder 19. A stem seal ring 80 is situated immediately underneath the flange 66 and forms a seal between the stem 56 and bushing 60. A bushing seal 82 is provided which contacts the inner surface of the upper end 21 of cylinder wall 17 so as to seal the bushing thereby completing the sealing of the radially inner end of chamber 19.

The piston support 52 includes on its upper end a threaded sleeve 84. The threaded sleeve is in turn unitarily formed with a stirrup portion 86 formed from a cylindrical portion 88 having an axial bore 89 which has been exposed by an opposed pair of flats 90–92. The lower end of piston support 52 includes a butt joint 94 which engages a corresponding butt joint 96 on piston 50. Both piston 50 and piston support 52 include sealing rings 98 which together with seals 80 and 82 require that the gas pressure or vacuum applied to cylinder 19 pass through the porous piston with the powdered material situated adjacent thereto.

In operation, the position of piston 50 and piston support 52 may be adjusted longitudinally within the cylinder 19 by means of rotation of stem 56. The rotation of the stem 56 does not affect the longitudinal position of the stem within the cylinder since the flange 66 retains the stem 56 in a fixed longitudinal position while permitting the stem to rotate upon its axis. The length of the stem 56 is preferably selected such that rotation of the stem 56 in one direction will position the porous head at about the longitudinal middle of chamber 19 as shown in FIG. 2. Rotation of the stem 56 in the opposite direction will cause the piston to move toward opening 18 at the radially outer end of cylinder 19. Preferably, the length of stem 56 and sleeve 84 is such that the porous piston head projects slightly out of the end 18 of cylinder 19 as the threaded portion 54 disengages from the threaded stem 56. This achieves the maximum variability needed to most effectively cover the desired range of doses with a single apparatus.

Although the invention has been described in detail with reference to the illustrated preferred embodiment, variations and modifications exist within the scope and spirit of the invention as described and as defined in the following claims.

What is claimed is:

1. Apparatus for apportioning powdered material comprising a cylindrical wall defining a chamber having an open end through which powdered material can be received and dispensed, at least one aperture in the wall for connection with a source of vacuum and pressure, a porous piston situated within the chamber between the at least one aperture and the open end, a threaded stem engaging the piston for adjusting the position of the piston within the chamber, and stem support means for rotatably supporting the stem at a fixed longitudinal position within the chamber comprising bushing means engaging the cylindrical wall and the stem, means for sealing the bushing means to the cylindrical wall, and means for sealing the bushing means to the stem.

2. An apparatus for apportioning powdered material into each of a series of containers, the apparatus including a powdered material hopper having a dispensing opening, a rotatable filling head contiguous to the dispensing opening including a plurality of radially situated chambers each having an inner end and an outer end, a pneumatic source for assisting in filling and emptying the chambers, a piston situated within each chamber to define the volume of powdered material received therein, the piston having a porous head through which pressure and vacuum from the pneumatic source can pass, a threaded stem engaging the piston, the stem being longitudinally fixed in position and rotatable about its longitudinal axis to effect adjustable displacement of the piston longitudinally within the chamber, a bushing means engaging the inner end of each chamber and the stem in each chamber, means for sealing an outer surface of the bushing means with an inner surface of the chamber, and means for sealing an outer surface of the stem to the bushing means.

3. The apparatus of claim 2 wherein the outer surface of the stem includes an o-ring groove and said means for sealing an outer surface of the stem to the bushing means comprises an o-ring situated within the o-ring groove, a radially outer surface of the o-ring being situated in sealing contact with an inner surface of the bushing means.

4. The apparatus of claim 2 wherein the bushing means includes an outer surface having an o-ring groove and said means for sealing an outer surface of the bushing means with an inner surface of the chamber comprises an o-ring situated in the o-ring groove, a radially outer surface of the o-ring being situated in sealing contact with an inner surface of the chamber.

* * * * *